United States Patent [19]

Harrington

[11] Patent Number: 4,815,244

[45] Date of Patent: Mar. 28, 1989

[54] CONCRETE BLOCK WALL INSULATION SYSTEM

[76] Inventor: Richard J. Harrington, 315 Seneca St., Apt. 1, Oneida, N.Y. 13421

[21] Appl. No.: 101,648

[22] Filed: Sep. 28, 1987

[51] Int. Cl.[4] ..... E04D 2/00

[52] U.S. Cl. ..... 52/169.11; 52/405; 52/743

[58] Field of Search ..... 52/743, 439, 441, 442, 52/440, 169.11, 405

[56] References Cited

U.S. PATENT DOCUMENTS

| | | | |
|---|---|---|---|
| 2,788,552 | 4/1957 | Miles | 52/743 X |
| 3,374,589 | 3/1968 | Neal, Jr. | 52/442 X |
| 4,123,881 | 11/1978 | Muse . | |
| 4,136,498 | 1/1979 | Kanigan | 52/442 X |
| 4,263,765 | 4/1981 | Maloney | 52/405 X |
| 4,269,013 | 5/1981 | West . | |
| 4,312,164 | 1/1982 | Walt et al. . | |
| 4,385,477 | 5/1983 | Walls et al. | 52/743 |
| 4,525,960 | 7/1985 | Kelman | 52/196.11 X |
| 4,712,347 | 12/1987 | Sperber | 52/743 X |

*Primary Examiner*—Carl D. Friedman

*Attorney, Agent, or Firm*—Stonebraker, Shepard & Stephens

[57] ABSTRACT

A thin barrier layer (20) is laid between courses of a concrete block wall (10) at or just below ground level (12) to intersect the hollow interior spaces (16) extending vertically within the wall, and particulate insulation material (25) is poured into the hollow interior spaces above the barrier layer, which holds the particulate insulation material within an upper region of the wall extending above ground. Below ground, wall (10) is insulated in the usual way with foamed resin panels (14) laid against the exterior of the wall, and the more expensive particulate insulation (25) is confined by barrier layer (20) to the upper region of the wall.

18 Claims, 1 Drawing Sheet

CONCRETE BLOCK WALL INSULATION SYSTEM

BACKGROUND

In recent past, concrete block walls for houses and other buildings were insulated with foamed resin paneling around their exteriors below ground level. Such insulation paneling was not extended above ground level, because the paneling could not withstand the harsh environment above ground. This left concrete block walls uninsulated from the ground level up to the sill level at the top of the wall. Presently, however, building codes have been changed to require that block walls be insulated all the way to the top of the wall above ground level. One way of doing this is to extend the foamed resin insulation paneling above ground level, secure it to the wall, and cover its exterior with a protective grout of a concrete-like material. Besides the extra expense, this raises problems of adherence and durability of the grout.

Various ways of insulating concrete block walls have been suggested in the patent literature, including U.S. Pat. Nos. 4,123,881; 4,269,013; and 4,312,164. The insulation methods of these patents are all relatively expensive, and none of them are competitive with foamed resin insulation paneling on the exterior of a wall below ground level. It is also possible to pour particulate insulation material into the hollow interior spaces of a concerete block wall, but this too is more expensive than foamed resin insulation panels. Especially now that building codes require insulation up to the sill level of concrete block walls, a low cost and effective way of insulating the top few courses of such walls is needed.

SUMMARY OF THE INVENTION

I have found a simple, effective, and inexpensive way of insulating a concrete block wall above ground level. By my invention, a thin barrier layer is laid between courses of the wall in a region ranging from ground level to somewhat below ground level so that the barrier layer intersects the hollow interior spaces that extend vertically within the wall. Then particulate insulation material is poured into the hollow interior spaces of the wall above the barrier layer, which holds the insulation particles within the wall, from the top of the wall down to the barrier layer, which does not let them fall to the bottom of the wall. The below ground region of the wall can then be insulated in the presently preferre way, using foamed resin panels laid along the exterior of the wall; and the more expensive particulate insulation material can be used only from the barrier layer up through the top course of the wall.

DRAWINGS

DETAILED DESCRIPTION

Figure 1:
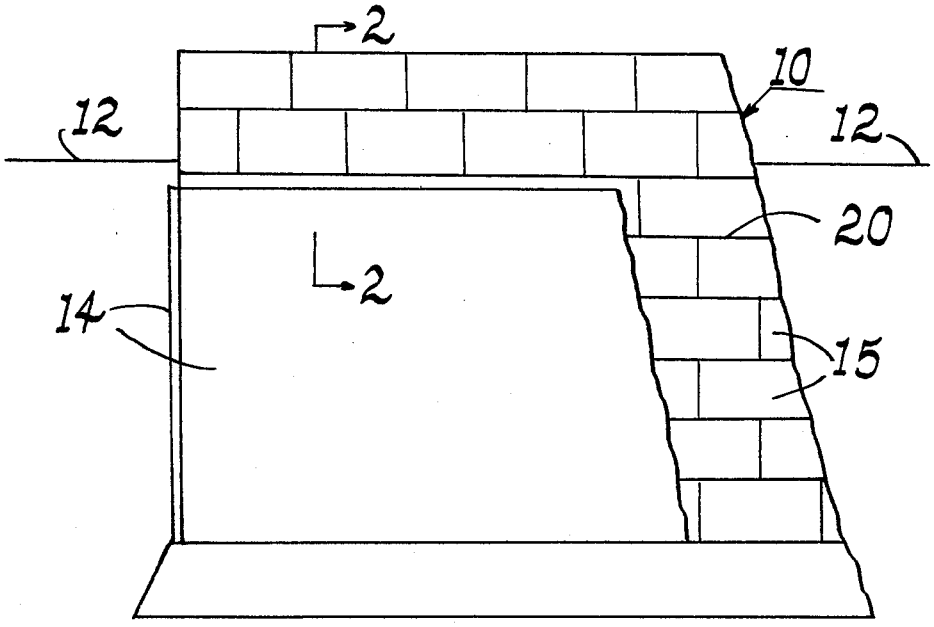
FIG. 1 is a partially cutaway, fragmentary view of a wall made according to my invention.

Wall 10 of FIG. 1 is made of blocks 15 formed of concrete, cement, or other materials and extends from a below ground footer 11 in courses of blocks 15 up to and above ground level 12. Below ground level 12, wall 10 is insulated with foamed resin panels 14 that are held against the exterior of wall 10 by back-filled earth. My invention involves a way of insulating the region of wall 10 from below ground level 12 up through the top course of the wall.

At or below ground level 12, and well above footing 11, I arrange a thin barrier layer 20 between courses of blocks 15. The tops of panels 14 are positioned just below ground level 12; and barrier layer 20 is positioned near, or preferably below, the tops of panels 14. I prefer that barrier layer 20 be a block or so below ground level 12, so that the insulation it supports overlaps with panels 14.

Barrier layer 20 is preferably a strip of material extending along the length of a course of blocks 15. Barrier 20 can be as wide as the blocks 15 in wall 10 or narrower than the width of blocks 15. Barrier 20 is preferably bonded between the courses of blocks 15 by the same mortar that bonds blocks 15 together.

Figure 4:
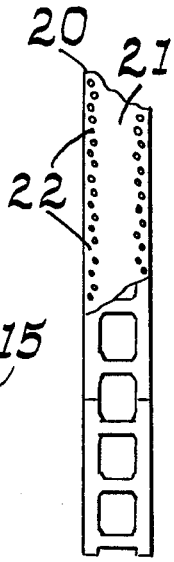
Figure 5:
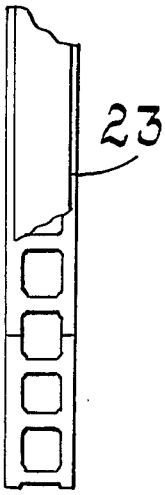

Barrier layer 20 can be formed of many materials. One that I prefer for barrier layer 20 is a screen material with a mesh about the size of window screening. Metal or plastic can be used for screening material in layer 20; and since mortar passes through screen material, it does not interfere with the bonding strength of the block courses between which it is inserted. It is also possible to use solid or perforated plastic or metal strip materials 21 for barrier layer 20, as shown in FIG. 4, where edge perforations 22 are provided to enhance the mortar bond between the courses above and below barrier layer 20. A perforated or unperforated strip 23, as shown in FIG. 5, can be narrower than the width of blocks 15 and wider than the openings 16 in blocks 15. Strip 23 can then cover openings 16 and leave uncovered regions along the outer edges of a course of blocks 15 in which mortar bonds the courses together.

Figure 2:
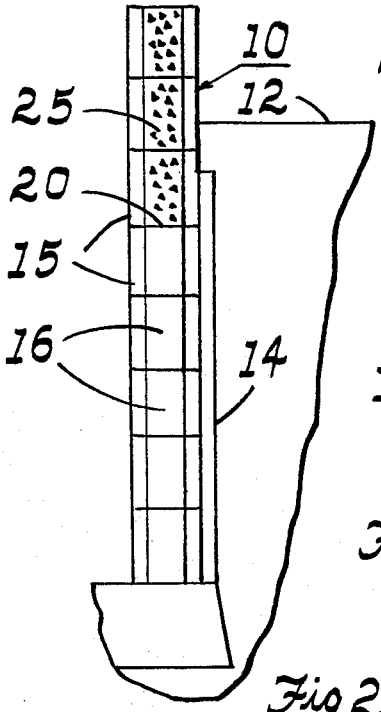
FIG. 2 is a fragmentary cross-sectional view of the wall of FIG. 1, taken along the line 2—2 thereof.
Figure 3:
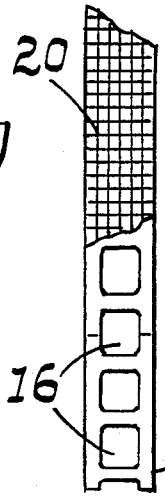
FIGS. 3–5 are fragmentary plan views of a course of the wall of FIG. 1 at or below ground level where respective alternative barrier layers are arranged.

Barrier layer 20 intersects and blocks off vertically extending hollow interior spaces 16 in the blocks 15 of wall 10, as best shown in FIG. 2. Barrier layer 20 also prevents the passage of particulate insulation material 25, which then can be poured into the top of wall 10 to pass downward into spaces 16 only as far as barrier layer 20. Vermiculite and other particulate insulation materials are usable for this, and, when poured into the top of wall 10, can fill hollow interior spaces 16 from barrier layer 20 at or below ground level 12 up to the top of wall 10. Barrier layer 20 supports the weight of insulation particles 25 extending upward to the top of wall 10 and conserves on the amount of insulation particles required, by confining them to the upper courses of wall 10. Less expensive foamed resin panels 14 can continue to be used for insulation below ground level 12. Wall 10 can then be fully insulated from its top to its footing 11, with only a moderate additional expense.

I claim:

1. A system of insulating an above ground region of a wall formed of courses of concrete blocks having vertically extending, hollow interior spaces, said wall extending below ground to a footer, said system comprising:

a. a thin barrier layer laid between said courses of said wall in a region ranging from ground level to below ground level above said footer so that said barrier layer intersects said hollow interior spaces extending vertically within said wall; and b. particulate insulation material poured into said hollow interior spaces above said barrier layer, which holds said particulate insulation material within an upper region of said wall between said barrier layer and a top of said wall.

2. The system of claim 1 wherein said barrier layer is a screen.

3. The system of claim 1 wherein said barrier layer is a perforated strip.

4. The system of claim 1 wherein said barrier layer is narrower than the width of said wall and wider than said hollow interior spaces.

5. The system of claim 1 wherein said barrier layer is an unperforated strip.

6. The system of claim 1 wherein said barrier layer is bonded in place by mortar bonding together said courses of said wall.

7. A method of insulating an upper region of a wall formed of courses of concrete blocks having hollow interior spaces, said wall extending from a footing below ground level to a top above ground level, said method comprising:

a. laying a barrier layer between said courses of said wall in a region ranging from ground level to below ground level above said footing; and b. pouring particulate insulation material into said hollow interior spaces of said wall above said barrier layer, which holds said insulation material within said upper region of said wall between said barrier layer and said top of said wall.

8. The method of claim 7 including using mortar bonding together said courses of said wall for bonding said barrier layer in place.

9. The method of claim 7 including using screen material for said barrier layer.

10. The method of claim 7 including using a perforated strip for said barrier layer.

11. The method of claim 7 including making said barrier layer narrower than the width of said wall and wider than said hollow interior spaces.

12. The method of claim 7 including using an unperforated strip for said barrier layer.

13. A wall formed of concrete blocks having hollow interior regions and laid in courses extending from a below ground footer to an above ground level, said wall comprising:

a. a barrier layer laid between said courses of said wall in a region ranging from ground level to below ground level above said footer; and b. particulate insulation material filling said hollow interior regions of said wall from said barrier layer to a top course of said wall.

14. The wall of claim 13 wherein said barrier layer is bonded in place by mortar that also bonds together said courses of said wall.

15. The wall of claim 13 wherein said barrier layer is formed of screen material.

16. The wall of claim 13 wherein said barrier layer is formed of a perforated strip.

17. The wall of claim 13 wherein said barrier layer is a strip narrower than said wall and wider than said interior regions.

18. The wall of claim 13 wherein said barrier layer is an unperforated strip.

* * * * *